US006890884B2

(12) United States Patent
Laney et al.

(10) Patent No.: US 6,890,884 B2
(45) Date of Patent: May 10, 2005

(54) THERMAL DYE-TRANSFER RECEIVER ELEMENT WITH MICROVOIDED LAYER

(75) Inventors: Thomas M. Laney, Spencerport, NY (US); Teh-Ming Kung, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 52 days.

(21) Appl. No.: 10/375,865

(22) Filed: Feb. 26, 2003

(65) Prior Publication Data

US 2004/0167022 A1 Aug. 26, 2004

(51) Int. Cl.[7] ..... B41M 5/035; B41M 5/38

(52) U.S. Cl. ..... 503/227; 264/173.11; 264/173.15; 264/173.16

(58) Field of Search ..... 8/471; 264/173.11, 264/173.15, 173.16; 503/227

(56) References Cited

U.S. PATENT DOCUMENTS 4,187,113 A 2/1980 Mathews et al. ..... 430/533
5,100,862 A 3/1992 Harrison et al. ..... 503/227
5,244,861 A * 9/1993 Campbell et al. ..... 503/227
6,096,684 A 8/2000 Sasaki et al. ..... 503/227
6,638,893 B2 * 10/2003 Laney et al. ..... 503/227

FOREIGN PATENT DOCUMENTS

EP 0 582 750 A1 2/1994
JP 63-198645 8/1988

* cited by examiner

*Primary Examiner*—Bruce H. Hess
(74) *Attorney, Agent, or Firm*—Chris P. Konkol; Kathleen Neuner Manne

(57) ABSTRACT

Disclosed is a thermal dye-transfer dye-image receiving element comprising a thermal dye-transfer receiver element comprising a dye-receiving layer 1; beneath layer 1, a microvoided layer 2 containing a continuous phase polyester matrix having dispersed therein a mixture of crosslinked organic microbeads and non-crosslinked polymer particles that are immiscible with the polyester matrix; beneath layer 2, a substrate layer 3 comprised of a voided or non-voided polyester material; and beneath layer 3, a composite support 4. The invention provides a receiver exhibiting an improved combination of dye-transfer efficiency and robustness.

38 Claims, No Drawings

THERMAL DYE-TRANSFER RECEIVER ELEMENT WITH MICROVOIDED LAYER

FIELD OF THE INVENTION

This invention relates to a thermal dye-transfer dye-image receiving element comprising an image receiving layer 1, beneath that a microvoided layer 2 comprising a continuous phase polyester matrix having dispersed therein crosslinked organic microbeads in combination with non-crosslinked polymer particles that are immiscible with the polyester matrix, and beneath the layer 2 a polyester layer 3 that can be voided or non-voided.

BACKGROUND OF THE INVENTION

In recent years, thermal transfer systems have been developed to obtain prints from pictures that have been generated electronically. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to the cyan, magenta and yellow signals. A color hard copy is thus obtained which corresponds to the original picture viewed on a screen. Further details of this process and an apparatus for carrying it out are set forth in U.S. Pat. No. 4,621,271.

Dye-receiving elements used in thermal dye transfer generally comprise a polymeric dye image-receiving layer coated on a support. Supports are required to have, among other properties, adequate strength, dimensional stability, and heat resistance. For reflective viewing, supports are also desired to be as white as possible. Cellulose paper and plastic films have been proposed for use as dye-receiving element supports in efforts to meet these requirements. Recently, microvoided films formed by stretching an orientable polymer containing an incompatible organic or inorganic material have been suggested for use in dye-receiving elements.

Various arrangements have been proposed to improve the imaging quality of dye image receiving layers in thermal dye-transfer elements. JP 88-198,645 suggests the use of a support comprising a polyester matrix with polypropylene particles as a dye donor element. EP 582,750 suggests the use of a non-voided polyester layer on a support.

U.S. Pat. No. 5,100,862 relates to microvoided supports for dye-receiving elements used in thermal dye transfer systems. Polymeric microbeads are used as void initiators in a polymeric matrix to enable higher dye transfer efficiency. A problem exists with such support, however, in that in order to attain the high level of voiding necessary for desired dye transfer efficiency, the volumetric loading of the microbeads needs to be above 25% by volume of the polymeric matrix. The degree of voiding is preferably from about 30 to 60 volume percent. At these levels of loading the tear strength of the film during manufacture is very low and results in very poor manufacturing efficiency due to tearing of the support.

U.S. Pat. No. 6,096,684 relates to porous polyester films suitable as supports for receiving elements used in thermal dye transfer systems. Polymers immiscible with a polyester are used in a base layer while an adjacent layer, upon which a dye receiving layer is formed, contains a polyester containing dispersed inorganic particles as void initiators. These inorganic particles are less than 1.0 $\mu$m in size. The porosity of layer (B) is specified to be not less than 20% by volume. This support solves the problem of poor adhesion of imaging layers to a support consisting only of layer (A). This support has also been shown to be manufacturable at high efficiency. A problem exists with this support, however, in that the hardness of the inorganic void initiators results in poor contact with the dye donor element. This results in low dye transfer efficiency for elements using such supports.

This problem was addressed by U.S. application Ser. No. 10/033,481 whereby the inorganic particles of layer (B) in U.S. Pat. No. 6,096,684 are replaced with polymeric microbeads. This significantly improved the dye transfer efficiency. This invention provides a thermal dye-transfer dye-image receiving element comprising a dye-receiving layer 1, a microvoided layer 2, beneath layer 1, containing a continuous phase polyester matrix having dispersed therein crosslinked organic microbeads and having a void volume of at least 25% by volume and, beneath layer 2, a microvoided layer 3 comprised of a continuous phase polyester matrix having dispersed therein non-crosslinked polymer particles that are immiscible with the polyester matrix of layer 3. The invention is said to provide a receiver exhibiting an improved combination of dye-transfer efficiency and tear strength.

It would be desirable to have a dye image-receiving element for thermal dye transfer which exhibits tear-resistance, a high dye transfer efficiency, which is capable of recording images (including color images) having high optical densities, high image quality, and capable of being manufactured at a relatively low cost.

SUMMARY OF THE INVENTION

The invention provides a thermal dye-transfer dye-image receiving element comprising:

(a) a dye-receiving layer 1;

(b) beneath layer 1, a microvoided layer 2 containing a continuous phase polyester matrix having dispersed therein crosslinked organic microbeads in combination with non-crosslinked polymer particles that are immiscible with the polyester matrix, said layer having a void volume of at least 25% by volume; and (c) beneath layer 2, a polyester layer 3.

In one embodiment of the invention, the polyester layer 3 is non-voided. In a second embodiment, the polyester layer 3 comprises a continuous phase polyester matrix having dispersed therein substantially only non-crosslinked polymer particles that are immiscible with the polyester matrix of layer 3.

The dye-receiving layer 1 may be coated onto layer 2 or coextrusion may be employed to form a composite film of layers 1, 2, and 3.

The invention provides a receiver exhibiting an improved combination of dye-transfer efficiency and tear strength.

DETAILED DESCRIPTION OF THE INVENTION

The invention is summarized above. The structure of the thermal dye-transfer receiving element can vary, but is generally a multilayer structure comprising three sections, namely, a dye-receiving layer, a composite compliant film comprising the microvoided layer or layers, and a composite support. In addition, tie layers or subbing layers can be employed between adjacent layers within a section or between sections. Typically, the receiving element has a total thickness of from 20 to 400 micrometers, preferably 30 to 300 micrometers.

The dye-receiving layer is any layer that will serve the function of receiving the dye transferred from the dye donor of the thermal element. Suitably it comprises a polymeric binder containing a polyester or a polycarbonate or a combination thereof. A desirable combination includes the polyester and polycarbonate polymers in a weight ratio of from 0.8 to 4.0:1.

The microvoided layer 2 provides more compliant properties to the receiver. This is important as it impacts the degree of contact to the thermal head during printing. Higher compliance results in better contact and higher dye transfer efficiency due to improved thermal transfer. Layer 3 further provides tearability and process robustness and structural integrity.

In one embodiment of a receiver structure, for example, beneath the dye-image receiving layer 1 there is a microvoided layer 2 beneath which there is a second microvoided layer 3 comprised of a second continuous phase polyester matrix having dispersed therein non-crosslinked polymer particles that are immiscible with the polyester matrix of said second microvoided layer. This composite comprising the two microvoided layers is laminated to a composite support.

In an alternative embodiment, beneath the microvoided layer, there is a microvoided layer 2 there is a layer comprised of a non-voided polyester. The composite comprising these two layers, in addition to the dye-image receiving layer, can be laminated to a composite support.

In a preferred embodiment, as indicated above, beneath the one or more microvoided layers is a paper-containing support, more preferably a resin-coated paper support. The support can comprise one or more subbing layers or tie layers.

Typically, a support comprises cellulose fiber paper. Preferably, the support is from 120 to 250 $\mu$m thick and the applied composite laminate film is from 30 to 50 $\mu$m thick. The support can further comprise a backing layer, preferably a polyolefin backing layer on the side of the support opposite to the composite film and a tie layer between the support and the laminate film.

The microvoided layer 2 of the element comprises a continuous phase polyester matrix having dispersed therein a mixture of two kinds of particles, crosslinked organic microbeads and non-crosslinked polymer particles. The non-crosslinked polymer particles are immiscible with the polyester matrix to form a microvoided layer with enhanced strength and quality.

In the prior art, microvoided polyester matrix layers have been formed by using either microbeads or non-crosslinked polymer particles that are immiscible with the polyester matrix. However, when only microbeads are used, then tear-strength or robustness may be inadequate.

When used as a thermal dye transfer imaging media, the image quality is very poor if only non-crosslinked polymer particles that are immiscible with the polyester matrix are used in the microvoided layer.

It has been unexpectedly discovered that by mixing both the crosslinked organic microbeads and the non-crosslinked polymer particles that are immiscible with the polyester matrix into the polyester matrix of the microvoided layer the deficiencies of the void initiators when used singularly are overcome.

The combination of the present invention enables the production of a thermal imaging element which is low in cost, is less brittle, more robust, and resistant to curl, while exhibiting high quality image properties, for example, high image density.

The terms as used herein, "top", "upper", and "face" mean the side or toward the side of the element receiving an image. The terms "bottom","lower side", and "back" mean the side opposite that which receives an image.

The term voids or microvoids means pores formed in an oriented polymeric film during stretching as the result of a void-initiating particle. In the present invention, these pores are initiated by either crosslinked organic microbeads or non-crosslinked polymer particles. The term microbead means synthesized polymeric spheres which, in the present invention, are cross-linked.

The continuous phase polyester matrix of the microvoided layer comprises any polyester and preferably comprises polyethylene(terephthalate) or a copolymer thereof. Suitable polyesters include those produced from aromatic, aliphatic, or cyclo-aliphatic dicarboxylic acids of 4–20 carbon atoms and aliphatic or alicyclic glycols having from 2–24 carbon atoms. Examples of suitable dicarboxylic acids include terephthalic, isophthalic, phthalic, naphthalene dicarboxylic acid, succinic, glutaric, adipic, azelaic, sebacic, fumaric, maleic, itaconic, 1,4-cyclohexane-dicarboxylic, sodiosulfoisophthalic, and mixtures thereof. Examples of suitable glycols include ethylene glycol, propylene glycol, butanediol, pentanediol, hexanediol, 1,4-cyclohexane-dimethanol, diethylene glycol, other polyethylene glycols and mixtures thereof. Such polyesters are well known in the art and may be produced by well-known techniques, for example, those described in U.S. Pat. Nos. 2,465,319 and 2,901,466. Preferred continuous matrix polymers are those having repeat units from terephthalic acid or naphthalene dicarboxylic acid and at least one glycol selected from ethylene glycol, 1,4-butanediol, and 1,4-cyclohexanedimethanol. Poly(ethylene terephthalate), which may be modified by small amounts of other monomers, is especially preferred. Other suitable polyesters include liquid crystal copolyesters formed by the inclusion of a suitable amount of a co-acid component such as stilbene dicarboxylic acid. Examples of such liquid crystal copolyesters are those disclosed in U.S. Pat. Nos. 4,420,607; 4,459,402; and 4,468,510.

The polyester utilized in the invention should have a glass transition temperature from 50 degrees C. to 150 degrees C., preferably from 60 to 100 degrees C., should be orientable, and have an intrinsic viscosity of at least 0.50 centipoise (CPE), preferably from 0.55 to 0.9 CPE. Examples include a blend comprising polyethylene(terephthalate) and poly(1,4-cyclohexylene dimethyhlene terephihalate.

The dye-transfer receiver element of the present invention comprises crosslinked organic microbeads. These crosslinked organic microbead spheres may range in size from 0.2 to 30 micrometers. They are preferably in the range of from 0.5 to 5.0 $\mu$m. Crosslinked organic microbeads comprising a polystyrene, polyacrylate, polyallylic, or poly (methacrylate) polymer are preferred. See also commonly assigned copending U.S. Ser. No. 10/033,457 and U.S. Ser. No. 10/374,639 and U.S. Ser. No. 10/033,457 to Smith et al., hereby incorporated by reference in their entirety.

Preferred polymers for use in the crosslinked organic microbeads may be cross-linked and may be selected from the group consisting of alkenyl aromatic compounds having the general formula:

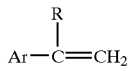

wherein. Ar represents an aromatic hydrocarbon moiety, or an aromatic halohydrocarbon moiety of the benzene series and R may be hydrogen or methyl moiety, acrylate-type monomers including monomers of the formula:

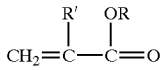

wherein R may be selected from the group consisting of hydrogen and an alkyl moiety containing from 1 to 12 carbon atoms and R' may be selected from the group consisting of hydrogen and methyl; copolymers of vinyl chloride and vinylidene chloride, acrylonitrile and vinyl chloride, vinyl bromide, vinyl esters having the formula:

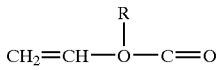

wherein R may bean alkyl group containing from 2 to 18 carbon atoms; acrylic acid, methacrylic acid, itaconic acid, citraconic acid, maleic acid, fumaric acid, oleic acid, vinylbenzoic acid; the synthetic polyester resins which may be prepared by reacting terephthalic acid and dialkyl terephthalics or ester-forming derivatives thereof, with a glycol of the series $HO(CH_2)_nOH$, wherein n may be a whole number within the range of 2–10 and having reactive olefinic linkages within the polymer molecule, the hereinabove described polyesters which include copolymerized therein up to 20 percent by weight of a second acid or ester thereof having reactive olefinic unsaturation and mixtures thereof, and a cross-linking agent selected from the group consisting of divinyl-benzene, diethylene glycol dimethacrylate, diallyl fumarate, diallyl phthalate, and mixtures thereof.

Examples of typical monomers for making the crosslinked organic microbeads include styrene, butyl acrylate, acrylamide, acrylonitrile, methyl methacrylate, ethylene glycol dimethacrylate, vinyl pyridine, vinyl acetate, methyl acrylate, vinylbenzyl chloride, vinylidene chloride, acrylic acid, divinylbenzene, arylamidomethyl-propane sulfonic acid, vinyl toluene, trimethylol propane triacrylate. Preferably, the cross-linked polymer may be poly(butyl acrylate) or poly(methyl methacrylate). Most preferably, it is a mixture of the two, and the cross-linking agent is trimethylol propane triacrylate.

In the present invention, for the polymer used to form the crosslinked organic microbead to have suitable physical properties such as resiliency, the polymer may be cross-linked. In the case of styrene cross-linked with divinylbenzene, the polymer may be from 2.5 to 50% cross-linked, and preferably from 20 to 40% cross-linked. Percent cross-linked means the mol % of cross-linking agent based on the amount of primary monomer. Such limited cross-linking produces crosslinked organic microbeads which are sufficiently coherent to remain intact during orientation of the continuous polymer. Crosslinked organic microbeads of such cross-linking may also be resilient, so that when they are deformed or flattened during orientation by pressure from the matrix polymer on opposite sides of the crosslinked organic microbeads, they subsequently resume their normal spherical shape to produce the largest possible voids around the crosslinked organic microbeads, thereby producing articles with less density.

The crosslinked organic microbeads may have a coating of a "slip agent". "Slip" means the friction at the surface of the crosslinked organic microbeads is greatly reduced. Actually, it is believed this may be caused by the silica acting as miniature ball bearings at the surface. Slip agent may be formed on the surface of the crosslinked organic microbeads during their formation by including it in the suspension polymerization mix. Suitable slip agents or lubricants include colloidal silica, colloidal alumina, and metal oxides such as tin oxide and aluminum oxide. The preferred slip agents are colloidal silica and alumina, most preferably, silica. The cross-linked polymer having a coating of slip agent may be prepared by procedures well known in the art. Conventional suspension polymerization processes, wherein the slip agent is added to the suspension, are preferred.

The crosslinked organic microbeads coated with slip agent may be prepared by various methods. The crosslinked organic microbeads may be prepared, for example, by a procedure in which monomer droplets containing an initiator may be sized and heated to give solid polymer spheres of the same size as the monomer droplets. In a preferred method, the polymer may be polystyrene cross-linked with divinylbenzene. The crosslinked organic microbeads may have a coating of silica. The concentration of divinylbenzene may be adjusted up or down to result in from 2.5 to 50% cross-linking by the active cross-linker, and preferably from 10 to 40% cross-linking by the active cross-linker. Of course, monomers other than styrene and divinylbenzene may be used in similar suspension polymerization processes known in the art. Also, other initiators and promoters may be used as known in the art. Slip agents other than silica may also be used. For example, a number of LUDOX® colloidal silicas arc available from DuPont. LEPANDIN® colloidal alumina is available from Degussa. NALCOAG® colloidal silicas are available from Nalco, and tin oxide and titanium oxide are also available from Nalco.

Crosslinked organic microbead size may be regulated by the ratio of silica to monomer. For example, the following ratios produce the indicated size crosslinked organic microbead:

| Crosslinked Organic Microbead Size, μm | Monomer, Parts by Wt. | Slip Agent (Silica) Parts by Wt. |
|---|---|---|
| 2 | 10.4 | 1 |
| 5 | 27.0 | 1 |
| 20 | 42.4 | 1 |

The crosslinked organic microbeads should be dispersed into the polyester matrix prior to extruding a pre-stretched film. This may be typically accomplished using a melt compounding process utilizing a twin screw extruder.

Processes well known in the art yield crosslinked organic microbeads suitable for use in the present invention. The processes known for making non-uniformly sized crosslinked organic microbeads may be characterized by broad particle size distributions and the resulting crosslinked organic beads may be classified by screening to produce beads spanning the range of the original distribution of sizes. Other processes such as suspension polymerization and limited coalescence directly yield very uniformly sized microbeads. Preferably, the crosslinked organic microbeads are synthesized using the limited coalescence process. This process is described in detail in U.S. Pat. No. 3,615,972. Preparation of the coated crosslinked organic microbeads for use in the present invention does not utilize a blowing agent as described in U.S. Pat. No. 3,615,972.

"Limited coalescence" is a phenomenon wherein droplets of liquid dispersed in certain aqueous suspending media coalesce, with formation of a lesser number of larger droplets, until the growing droplets reach a certain critical and limiting size, whereupon coalescence substantially ceases. The resulting droplets of dispersed liquid, which may be as large as 0.3 and sometimes 0.5 centimeter in diameter, are quite stable, as regards further coalescence, and are remarkably uniform in size. If such a large droplet dispersion is vigorously agitated, the droplets may be fragmented into smaller droplets. The fragmented droplets, upon quiescent standing, again coalesce to the same limited degree and form the same uniform-sized, large droplet, stable dispersion. Thus, a dispersion resulting from the limited coalescence comprises droplets of substantially uniform diameter that are stable in respect to further coalescence.

The principles underlying the limited coalescence phenomenon have now been adapted to cause the occurrence of limited coalescence in a deliberate and predictable manner in the preparation of dispersions of polymerizable liquids in the form of droplets of uniform and desired size.

In the phenomenon of limited coalescence, the small particles of solid colloid tend to collect with the aqueous liquid at the liquid-liquid interface, that is, on the surface of the oil droplets. It is thought that droplets which are substantially covered by such solid colloid may be stable to coalescence while droplets which are not so covered may not be stable. In a given dispersion of a polymerizable liquid, the total surface area of the droplets is a function of the total volume of the liquid and the diameter of the droplets. Similarly, the total surface area barely coverable by the solid colloid, for example, in a layer one particle thick, is a function of the amount of the colloid and the dimensions of the particles thereof. In the dispersion as initially prepared, for example, by agitation, the total surface area of the polymerizable liquid droplets may be greater than may be covered by the solid colloid. Under quiescent conditions, the unstable droplets begin to coalesce. The coalescence results in a decrease in the number of oil droplets and a decrease in the total surface area thereof up to a point at which the amount of colloidal solid may be barely sufficient to cover the total surface of the oil droplets, whereupon coalescence substantially ceases.

If the solid colloidal particles do not have nearly identical dimensions, the average effective dimension may be estimated by statistical methods. For example, the average effective diameter of spherical particles may be computed as the square root of the average of the squares of the actual diameters of the particles in a representative sample.

It may be beneficial to treat the uniform droplet suspension prepared as described above to render the suspension stable against congregation of the oil droplets. This further stabilization may be accomplished by gently admixing an agent capable of greatly increasing the viscosity of the aqueous liquid with the uniform droplet dispersion. For this purpose, any water-soluble or water-dispersible thickening agent may be used that is insoluble in the oil droplets and that does not remove the layer of solid colloidal particles covering the surface of the oil droplets at the oil-water interface. Examples of suitable thickening agents may be sulfonated polystyrene, for example, water-dispersible, thickening grade, hydrophilic clays such as Bentonite, digested starch, natural gums, and carboxy-substituted cellulose ethers. The thickening agent may be selected and employed in such quantities as to form a thixotropic gel in which the uniform-sized droplets of the oil may be suspended. In other words, the thickened liquid generally should be non-Newtonian in its fluid behavior, that is, of a nature to prevent rapid movement of the dispersed droplets within the aqueous liquid by the action of gravitational force due to the difference in density of the phases. The stress exerted on the surrounding medium by a suspended droplet may not be sufficient to cause rapid movement of the droplet within such non-Newtonian media. Usually, the thickener agents may be employed in such proportions relative to the aqueous liquid that the apparent viscosity of the thickened aqueous liquid is in the order of at least 500 centipoise as determined by means of a Brookfield viscometer using the No. 2 spindle at 30 rpm. The thickening agent is preferably prepared as a separate concentrated aqueous composition that is then carefully blended with the oil droplet dispersion. The resulting thickened dispersion is capable of being handled, for example, passed through pipes, and may be subjected to polymerization conditions substantially without mechanical change in the size or shape of the dispersed oil droplets.

The resulting dispersions may be particularly well suited for use in continuous polymerization procedures that may be carried out in coils, tubes, and elongated vessels adapted for continuously introducing the thickened dispersions into one end and for continuously withdrawing the mass of polymer beads from the other end. The polymerization step may also be practiced in batch manner.

The order of the addition of the constituents to the polymerization usually is not critical, but it may be more convenient to add the water, dispersing agent, and incorporated oil-soluble catalyst to the monomer mixture to a vessel and subsequently add the monomer phase to the water phase with agitation.

The following general procedure may be utilized in a limited coalescence technique:

1. The polymerizable liquid is dispersed within an aqueous non-solvent liquid medium to form a dispersion of droplets having sizes not larger than the size desired for the polymer globules, whereupon 2. The dispersion is allowed to rest and to reside with only mild or no agitation for a time during which a limited coalescence of the dispersed droplets takes place with the formation of a lesser number of larger droplets, such coalescence being limited due to the composition of the suspending medium, the size of the dispersed droplets thereby becoming remarkably uniform and of a desired magnitude, and 3. The uniform droplet dispersion is then stabilized by addition of thickening agents to the aqueous suspending medium, whereby the uniform-sized dispersed droplets are further protected against coalescence and are also retarded from concentrating in the dispersion due to difference in density of the disperse phase and continuous phase, and 4. The polymerizable liquid or oil phase in such stabilized dispersion is subjected to polymerization conditions and polymerized, whereby globules of polymer are obtained having spheroidal shape and remarkably uniform and desired size, which size is predetermined principally by the composition of the initial aqueous liquid suspending medium.

The diameter of the droplets of polymerizable liquid and, hence, the diameter of the beads of polymer, may be varied predictably, by deliberate variation of the composition of the aqueous liquid dispersion, within the range of from 0.5 μm or less to 0.5 centimeter. For any specific operation, the range of diameters of the droplets of liquid and, hence, of polymer beads, has a factor in the order of three or less as contrasted to factors of 10 or more for diameters of droplets and beads prepared by usual suspension polymerization methods employing critical agitation procedures. Since the bead size, for example, diameter, in the present method is determined principally by the composition of the aqueous dispersion, the mechanical conditions, such as the degree of agitation, the size and design of the apparatus used, and the scale of operation are not highly critical. Furthermore, by employing the same composition, the operations may be repeated, or the scale of operations may be changed, and substantially the same results may be obtained.

One bead formation method may be carried out by dispersing one part by volume of a polymerizable liquid into at least 0.5, preferably from 0.5 to 10 or more parts by volume of a non-solvent aqueous medium comprising water and at least the first of the following ingredients:

1. A water-dispersible, water-insoluble solid colloid, the particles of which, in aqueous dispersion, have dimensions in the order of from 0.008 to 50 μm, which particles tend to gather at the liquid-liquid interface or are caused to do so by the presence of 2. A water-soluble "promoter" that affects the "hydrophilic-hydrophobic balance" of the solid colloid particles; and/or 3. An electrolyte; and/or 4. Colloid-active modifiers such as peptizing agents, and surface-active agents; and usually, 5. A water-soluble, monomer-insoluble inhibitor of polymerization.

The water-dispersible, water-insoluble solid colloids may be inorganic materials, such as metal salts, hydroxides or clays, or may be organic materials, such as raw starches, sulfonated cross-linked organic high polymers, and resinous polymers.

The solid colloidal material should be insoluble but dispersible in water and both insoluble and nondispersible in, but wettable by, the polymerizable liquid. The solid colloids should be much more hydrophilic than oleophilic to remain dispersed wholly within the aqueous liquid. The solid colloids employed for limited coalescence are ones having particles that, in the aqueous liquid, retain a relatively rigid and discrete shape and size within the limits stated. The particles may be greatly swollen and extensively hydrated, provided that the swollen particle retains a definite shape, in which case the effective size may be approximately that of the swollen particle. The particles may be single molecules, as in the case of extremely high molecular weight cross-linked resins, or may be aggregates of many molecules. Materials that disperse in water to form true or colloidal solutions in which the particles have a size below the range stated or in which the particles may be so diffuse as to lack a discernible shape and dimension may be not suitable as stabilizers for limited coalescence. The amount of solid colloid that maybe employed usually corresponds to from 0.01 to 10 or more grams per 100 cubic centimeters of the polymerizable liquid.

In order to function as a stabilizer for the limited coalescence of the polymerizable liquid droplets, it may be essential that the solid colloid should tend to collect with the aqueous liquid at the liquid-liquid interface, that is, on the surface of the oil droplets. The term "oil" may be occasionally used herein as generic to liquids that are insoluble in water. In many instances, it may be desirable to add a "promoter" material to the aqueous composition to drive the particles of the solid colloid to the liquid-liquid interface. This phenomenon is well known in the emulsion art, and is here applied to solid colloidal particles, as an expanded means of adjusting the "hydrophilic-hydrophobic balance".

Usually, the promoters are organic materials that have an affinity for the solid colloid and also for the oil droplets and that may be capable of making the solid colloid more oleophilic. The affinity for the oil surface may be due to some organic portion of the promoter molecule, while affinity for the solid colloid may be due to opposite electrical charges. For example, positively charged complex metal salts or hydroxides, such as aluminum hydroxide, may be promoted by the presence of negatively charged organic promoters such as water-soluble sulfonated polystyrenes, alignates, and carboxymethylcellulose. Negatively charged colloids, such as Bentonite, may be promoted by positively charged promoters such as tetramethyl ammonium hydroxide or chloride or water-soluble complex resinous amine condensation products, such as the water-soluble condensation products of diethanolamine and adipic acid, the water-soluble condensation products of ethylene oxide, urea and formaldehyde, and polyethylenimine. Amphoteric materials, such as proteinaceous materials like gelatin, glue, casein, albumin, or glutin, may be effective promoters for a wide variety of colloidal solids. Nonionic materials like methoxycellulose may also be effective in some instances. Usually, the promoter should be used only to the extent of a few parts per million of aqueous medium, although larger proportions may often be tolerated. In some instances, ionic materials normally classed as emulsifiers, such as soaps, long chain sulfates and sulfonates and the long chain quaternary ammonium compounds, may also be used as promoters for the solid colloids, but care should be taken to avoid causing the formation of stable colloidal emulsions of the polymerizable liquid and the aqueous liquid medium.

An effect similar to that of organic promoters may be obtained with small amounts of electrolytes, for example, water-soluble, ionizable alkalis, acids and salts, particularly those having polyvalent ions. These may be useful when the excessive hydrophilic or insufficient oleophilic characteristic of the colloid is attributable to excessive hydration of the colloid structure. For example, a suitably cross-linked sulfonated polymer of styrene may be swollen and hydrated in water. Although the molecular structure contains benzene rings which should confer on the colloid some affinity for the oil phase in the dispersion, the degree of hydration causes the colloidal particles to be enveloped in a cloud of associated water. The addition of a soluble, ionizable polyvalent cationic compound, such as an aluminum or calcium salt, to the aqueous composition may cause extensive shrinking of the swollen colloid with exudation of a part of the associated water and exposure of the organic portion of the colloid particle, thereby making the colloid more oleophilic.

The solid colloidal particles whose hydrophilic-hydrophobic balance may be such that the particles tend to gather in the aqueous phase at the oil-water interface, gather on the surface of the oil droplets, and function as protective agents during limited coalescence.

Other agents that may be employed in an already known manner to effect modification of the colloidal properties of the aqueous composition are those materials known in the art as peptizing agents, flocculating and deflocculating agents, sensitizers, and surface active agents.

It is sometimes desirable to add a few parts per million of a water-soluble, oil-insoluble inhibitor of polymerization to the aqueous liquid to prevent the polymerization of monomer molecules that might diffuse into the aqueous liquid or that might be absorbed by colloid micelles and that, if allowed to polymerize in the aqueous phase, would tend to make emulsion-type polymer dispersions instead of, or in addition to, the desired bead or pearl polymers.

The aqueous medium containing the water-dispersible solid colloid may then be admixed with the liquid polymerizable material in such a way as to disperse the liquid polymerizable material as small droplets within the aqueous medium. This dispersion may be accomplished by any usual means, for example, by mechanical stirrers or shakers, by pumping through jets, by impingement, or by other procedures causing subdivision of the polymerizable material into droplets in a continuous aqueous medium.

The degree of dispersion, for example, by agitation, is not critical, although the size of the dispersed liquid droplets should be no larger, and may be preferably much smaller, than the stable droplet size expected and desired in the stable dispersion. When such condition has been attained, the resulting dispersion may be allowed to rest with only mild, gentle movement, if any, and preferably without agitation. Under such quiescent conditions, the dispersed liquid phase undergoes a limited degree of coalescence.

The non-cross linked polymer particles in the voided layer should be immiscible with the polyester matrix. Typical non-crosslinked polymer particles that are immiscible with the polyester matrix particles are olefins. The preferred olefin non-crosslinked polymer particles which may be blended with the polyester matrix are a homopolymers or copolymers of polypropylene or polyethylene. Polypropylene is preferred.

The preferred polyolefin non-crosslinked polymer particles used according to this invention are immiscible with the polyester matrix component of the film and exists in the form of discrete non-crosslinked polymer particles dispersed throughout the oriented and heat set film. Voiding occurs between the non-crosslinked polymer particles and the polyester matrix, when the film is stretched. It has been discovered that the non-crosslinked polymer particles should be blended with the linear polyester matrix prior to extrusion through the film forming die by a process which results in a loosely blended mixture and does not develop an intimate bond between the polyester matrix and the preferred polyolefin non-crosslinked polymer particles.

Such a blending operation preserves the incompatibility of the components and leads to voiding when the film is stretched. A process of dry blending the polyester matrix and preferred polyolefin non-crosslinked polymer particles has been found to be useful. For instance, blending may be accomplished by mixing finely divided, for example powdered or granular, polyester matrix and non-crosslinked polymer particles and thoroughly mixing them together, for example, by tumbling them.

In order to form the microvoided layer of this invention, crosslinked organic microbeads should first be dispersed into a polyester matrix prior to the film forming process. This may be accomplished by feeding both the polyester matrix, in either pellet or powder form, and the crosslinked organic microbeads into a twin screw extruder. The polyester matrix may be melted and the crosslinked organic microbeads may be dispersed into the polyester melt in the twin screw extruder. The resulting extrudate may be then quenched in a water bath and then pelletized into pellets to be used in the film forming process. These pellets may be then dry blended with the preferred polyolefin non-crosslinked polymer particle of choice, typically a polypropylene. The preferred polyolefin non-crosslinked polymer particle may be typically in pellet form as well. Pellets of polyester matrix may also be added to the dry blend if modifications to the volumetric loading of the crosslinked organic microbeads and the non-crosslinked polymer particles are desired. The ratio of the volume of crosslinked organic microbeads used relative to the volume of the non-crosslinked polymer particle polymer used in the final blend may range from 4:1 to 1:4, preferably 2:3 to 3:2. Apreferred ratio is about 1:1.

The resulting mixture, for making layer 2, may then be fed to the film forming extruder along with the material for the one or more other layers to be coextruded, thereby forming a composite film (multilayer). The extrusion, quenching and stretching of the composite film may be effected by any process which is known in the art for producing oriented polyester film, for example by a flat film process or a bubble or tubular process. The flat film process is preferred for making film according to this invention and involves extruding the blend through a slit die and rapidly quenching the extruded web upon a chilled casting drum so that the polyester matrix component of the film may be quenched into the amorphous state. The quenched composite film may be then biaxially oriented by stretching in mutually perpendicular directions at a temperature above the glass-rubber transition temperature of the polyester matrix. Generally the composite film is stretched in one direction first and then in the second direction although stretching maybe effected in both directions simultaneously if desired. In a typical process, the composite film is stretched firstly in the direction of extrusion over a set of rotating rollers or between two pairs of nip rollers and is then stretched in the direction transverse thereto by means of a tenter apparatus. The composite film may be stretched in each direction to 2.5 to 4.5 times its original dimension in the direction of stretching. The ratio of the stretching in each direction is preferably such as to form voids in the sheet with a width to length ratio of from 1:1 to 2:1. After the composite film has been stretched it may be heat set by heating to a temperature sufficient to crystallize the polyester matrix while restraining the composite film against retraction in both directions of stretching. When a non-crosslinked polymer particle is used in the voided layer, the voiding tends to collapse as the heat setting temperature is increased and the degree of collapse increases as the temperature increases. Hence the void volume decreases with an increase in heat setting temperatures. While heat setting temperatures up to 230° C. may be used without destroying the voids when only crosslinked organic microbeads are used in the voided layer, temperatures below 155° C. may result in a greater degree of voiding when non-crosslinked polymer particle voiding agent is used.

The size of the microvoids formed is determined by the size of the crosslinked organic microbead or non-crosslinked polymer particle used to initiate the void and by the stretch ratio used to stretch the oriented polymeric film. The pores may range from 0.6 to 150 μm in machine and cross machine directions of the film. They typically range from 0.2 to 30 μm in height. Preferably the height of the pores is in the range of 0.5 to 15.0 μm.

A void volume of from 25% to 55% is preferred for thermal dye transfer elements. The density of the microvoided layer should be less than 0.95 grams/cc. The preferred range is 0.40 to 0.90 grams/cc.

Structures: The voided layer described above may constitutes one layer of a thermal dye-transfer receiving element. The total thickness of the element may range from 20 to 400 (μm). Most applications require a thickness to be within the range of from 30 to 300 (μm), preferably 50 to 200 (μm).

The thermal dye-transfer receiving elements of the invention typically comprise, on the top surface, a dye-image receiving layer that may comprise, for example, a polycarbonate, a polyurethane, a polyester, polyvinyl chloride, poly(styrene-co-acrylonitrile), poly(caprolactone) or mixtures thereof. The dye image-receiving layer may be present in any amount which is effective for the intended purpose. In general, good results have been obtained at a concentration of from about 1 to about 5 g/m$^2$. In a preferred embodiment of the invention, the dye image-receiving layer is a polycarbonate, polyester or blend of the two. The term "polycarbonate" as used herein means a polyester of carbonic acid and a glycol or a dihydric phenol. Examples of such glycols or dihydric phenols are p-xylylene glycol, 2,2-bis(4-oxyphenyl)propane, bis(4-oxyphenyl)methane, 1,1-bis(4-oxyphenyl)ethane, 1,1-bis(oxyphenyl)butane, 1,1-bis(oxyphenyl)cyclohexane, and 2,2-bis(oxyphenyl)butane. In a particularly preferred embodiment, a bisphenol-A polycarbonate having a number average molecular weight of at least about 25,000 is used. Examples of preferred polycarbonates include General Electric LEXAN® Polycarbonate Resin and Bayer AG MACROLON 5700®.

In a preferred embodiment of the invention, the dye-image receiving layer comprises a polymeric binder containing a polyester and/or polycarbonate. In another embodiment, the dye-image receiving layer comprises a blend of a polyester and a polycarbonate polymer. Preferably, such blends comprise the polyester and polycarbonate in a weight ratio of polyester to polycarbonate of 10:90 to 90:10, preferably 0.8:1 to 4.0:1. In the preferred embodiment, the polyester comprises polyethylene (terephthalale) or a blend thereof. For example, in one embodiment of the invention, a polyester polymer is blended with an unmodified bispbenol-A polycarbonate and at a weight ratio to produce the desired Tg of the final blend and to minimize cost. Conveniently, the polycarbonate and polyester polymers may be blended at a weight ratio of from about 75:25 to about 25:75. The following polyester polymers E-1 and E-2 comprised of recurring units of the illustrated monomers, are examples of polyester polymers usable in the receiving layer polymer blends of the invention.

E-1: Polymer derived from 1,4-cyclohexanedicarboxylic acid, 4,4'-bis(2-hydroxyethyl)bisphenol-A and 1,4-cyclohexanedimethanol represented by the following structure:

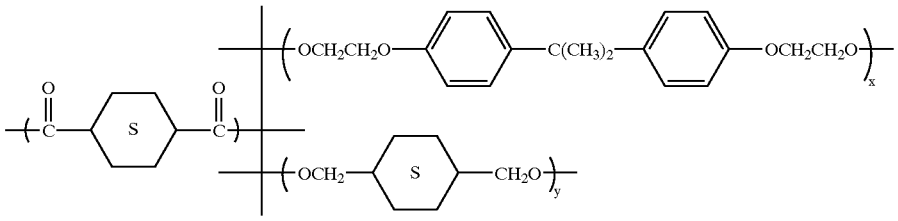

x=50 mole % m=50 mole %

(mole % based on total monomer charge of acid and glycol monomers)

E-2: A polymer, useful in making an extruded dye-receiving layer, is derived from 1,4-cyclohexanedicarboxylic acid, 1,4-cyclohexanedimethanol, 4,4'-bis(2-hydroxyethyl)bisphenol-A and 2-ethyl-2-(hydroxymethyl)-1,3-propanediol represented by the following structure.

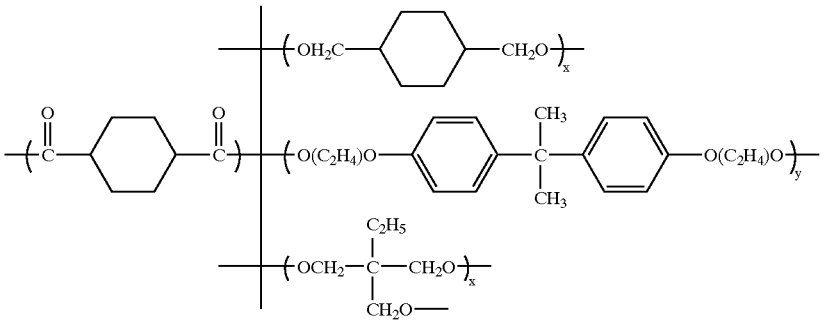

x=48 mole % y=50 mole % z=2 mole %

Further examples of polymeric compositions and related processing of dye-receiving layers are disclosed in commonly assigned, concurrently filed copending U.S. Ser. No. 10/376,188 to Kung et al., hereby incorporated by reference in its entirety.

As conventional, the dye-image receiving layer further can further comprise a release agent. Conventional release agents include but are not limited to silicone or fluorine based compound. Resistance to sticking during thermal printing may be enhanced by the addition of such release agents to the dye-receiving layer or to an overcoat layer. Various releasing agents are disclosed, for example, in U.S. Pat. No. 4,820,687 and U.S. Pat. No. 4,695,286, the disclosures of which are hereby incorporated by reference in their entirety.

A preferred release agent, especially for an extruded dye-receiving layer, are high or ultrahigh molecular weight silicone-based compounds. Preferably, the weight average molecular weight of the compound or polymer should be at least 100,000, more preferably at least 500,000, most preferably at least 1,000,000, for example, between 1,000,000 and 5,000,000. The silicone release agent should be compatible with the polymers used in the dye receiving layer. When the dye-receiving layer contains a polyearbonate, it is preferred for the release agent to have hydroxy terminal groups to improve the compatibility of the silicone compound in the polycarbonate-containing blend.

High or ultrahigh molecular weight silicone release agents are commercially available, for example, from Dow Corning (Midland, Mich.), including MB50-315 and MB-010. MB50-315 is a hydroxy-terminated dimethyl siloxane. MB50-315 silicone material is commercially available as a 50 weight percent mixture of pelletized solid polydimethylsiloxane dispersed in polycarbonate polymer. Depending on the composition of the dye-receiving layer, other dispersions may be preferred, for example, MB50-010 from Dow Corning which is a dispersion in polyester.

A plasticizer may be present in the dye image-receiving layer in any amount which is effective for the intended purpose. In general, good results have been obtained when the plasticizer is present in an amount of from about 5 to about 100%, preferably from about 10 to about 20%, based on the weight of the polymeric binder in the dye image-receiving layer.

In one embodiment of the invention, an aliphatic ester plasticizer is employed in the dye image-receiving layer. Suitable aliphatic ester plasticizers include both monomeric esters and polymeric esters. Examples of aliphatic monomeric esters include ditridecyl phthalate, dicyclohexyl phthalate and dioctylsebacate. Examples of aliphatic polyesters include polycaprolactone, poly(1,4-butylene adipate) and poly(hexamethylene sebacate).

In a preferred embodiment of the invention, the monomeric ester is dioctylsebacate or bis-(1-octyloxy-2,2,6,6-tetramethyl-4-piperidinyl) sebacate, Tinuvin 123® (Ciba Geigy Co.). In another preferred embodiment, the aliphatic polyester is poly(1,4-butylene adipate) or the 1,3-butane diol polymer with hexanedioc acid, 2-ethylhexyl ester, poly(1,3-butylene glycol adipate) sold commercially as Admex 429® (Velsicol Chemical Corp.), or poly(hexamethylene sebacate).

If the dye-receiving layer is to be made by extruding rather than by solvent coating the dye-receiving layer, then it has been found advantageous to include, as an additive to the composition of the dye-receiving layer, a phosphorous-containing stabilizer such as phosphorous acid or an organic diphosphite such as bis(2-ethylhexyl)phosphite, to prevent degradation of the polyester polymer blend during high temperature melt extrusion. The phosphorous stabilizer can be combined, for example, with a plasticizer such as dioctyl sebacate or the like. Preferably, to improve compatibility, the plasticizer is combined with the stabilizer prior to combining both with the other components of the dye receiving layer.

Further details of a preferred dye-receiving element are disclosed in copending, commonly assigned U.S. Ser. No. 10/376,188 to Kung et al., hereby incorporated by reference.

As mentioned above, a polyester layer 3 can comprise a voided or non-voided material. In a preferred embodiment, layer 3 comprises a microvoided layer comprising any polyester, conveniently comprising polyethylene (terephthalate) or a copolymer thereof, having immiscible particles suitably particles based on a polyolefin having an olefinic backbone. Examples include polypropylene, polyethylene, and polystyrene, especially polypropylene. The microvoided layer 3 desirably has a density of less than 0.95 grams/cc and, more typically, a density of between 0.4 and 0.85 grams/cc. The layer 3, in this case, desirably has a void volume of greater than 30 volume % with a void volume of 35–55% being typical.

If desired, the layer 3 may be disposed on a further optional support such as a paper support. Layers 1, 2, and 3 together usually exhibit a total thickness of from 20 to 400, with values of 30–300 or 50–200 micrometers being typical. Depending on the manufacturing method employed and desired finished properties, the element may include one or more subbing layers between the layers. Such layers may be employed for any of the known reasons such as adhesion or antistatic properties. It is also possible to employ no subbing layer between layer pairs, particularly where coextrusion of the adjacent layers is employed.

As indicated above, layer 3 can then be laminated to a support, preferably a composite (multilayer) support, which support may be either transparent or opaque. Opaque supports include plain paper, coated paper, resin-coated paper such as polyolefincoated paper, synthetic paper, photographic paper support, melt-extrusion-coated paper, and polyolefin-laminated paper. Biaxially oriented supports include a paper base and a biaxially oriented polyolefin sheet, typically polypropylene, laminated to one or both sides of the paper base. The support may also consist of microporous materials such as polyethylene polymer-containing material sold by PPG Industries, Inc., Pittsburgh, Pa. under the trade name of Teslin®, Tyvek® synthetic paper (DuPont Corp.), impregnated paper such as Duraform®, and OPPalyte® films (Mobil Chemical Co.) and other composite films listed in U.S. Pat. No. 5,244,861. Transparent supports include glass, cellulose derivatives, such as a cellulose ester, cellulose triacetate, cellulose diacetate, cellulose acetate propionate, cellulose acetate butyrate, polyesters, such as poly(etbylene terephthalate), poly(ethylene naphthalate), poly-1,4-cyclohexanedimethylene terephthalate, poly(butylene terephthalate), and copolymers thereof, polyimides, polyamides, polycarbonates, polystyrene, polyolefins, such as polyethylene or polypropylene, polysulfones, polyacrylates, polyether imides, and mixtures thereof. The papers listed above include a broad range of papers, from high end papers, such as photographic paper to low end papers, such as newsprint. In a preferred embodiment, Ektacolor paper made by Eastman Kodak Co. may be employed.

Dye Donor: A dye-donor element that is used with the thermal dye-receiving element of the invention comprises a support having thereon a dye containing layer. Any dye can be used in the dye-donor employed in the invention provided it is transferable to the dye-receiving layer by the action of heat. Especially good results have been obtained with sublimable dyes such as anthraquinone dyes, e.g., Sumikalon Violet RS® (product of Sumitomo Chemical Co., Ltd.), Dianix Fast Violet 3RFS® (product of Mitsubishi Chemical Industries, Ltd.), and Kayalon Polyol Brilliant Blue N-BGM® and KST Black 146® (products of Nippon Kayaku Co., Ltd.); azo dyes such as Kayalon Polyol Brilliant Blue BM®, Kayalon Polyol Dark Blue 2BM®, and KST Black KR® (products of Nippon Kayaku Co., Ltd.), Sumickaron Diazo Black 5G® (product of Sumitomo Chemical Co., Ltd.), and Miktazol Black 5GH® (product of Mitsui Toatsu Chemicals, Inc.); direct dyes such as Direct Dark Green B® (product of Mitsubishi Chemical Industries, Ltd.) and Direct Brown M® and Direct Fast Black D® (products of Nippon Kayaku Co. Ltd.); acid dyes such as Kayanol Milling Cyanine 5R® (product of Nippon Kayaku Co. Ltd.); basic dyes such as Sumicacryl Blue 6G® (product of Sumitomo Chemical Co., Ltd.), and Aizen Malachite Green® (product of Hodogaya Chemical Co., Ltd.);

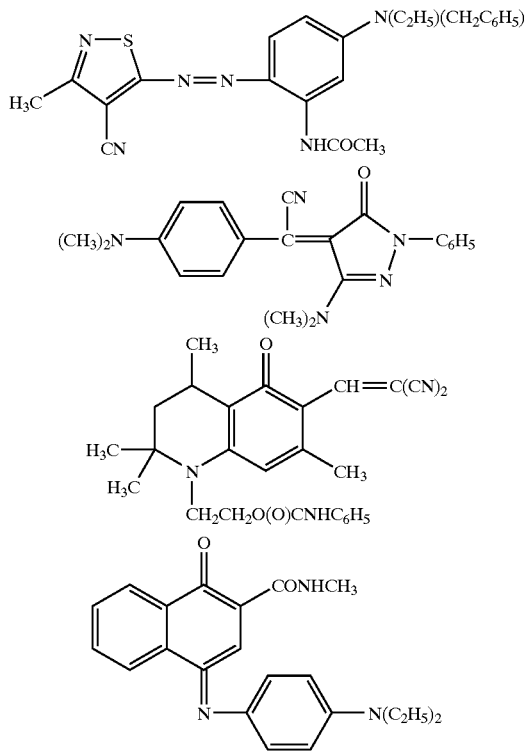

or any of the dyes disclosed in U.S. Pat. No. 4,541,830, the disclosure of which is hereby incorporated by reference. The above dyes may be employed singly or in combination to obtain a monochrome. The dyes may be used at a coverage of from about 0.05 to about 1 g/m2 and are preferably hydrophobic.

The dye in the dye-donor element is dispersed in a polymeric binder such as a cellulose derivative, e.g., cellulose acetate hydrogen phthalate, cellulose acetate, cellulose acetate propionate, cellulose acetate butyrate, cellulose triacetate; a polycarbonate; poly(styrene-co-acrylonitrile), a poly(sulfone) or a poly(phenylene oxide). The binder may be used at a coverage of from about 0.1 to about 5 g/m$^2$.

The dye layer of the dye-donor element may be coated on the support or printed thereon by a printing technique such as a gravure process. The reverse side of the dye-donor element can be coated with a slipping layer to prevent the printing head from sticking to the dye-donor element. Such a slipping layer would comprise a lubricating material such as a surface active agent, a liquid lubricant, a solid lubricant or mixtures thereof, with or without a polymeric binder. Preferred lubricating materials include oils or semi-crystalline organic solids that melt below 100° C. such as poly(vinyl stearate), beeswax, perfluorinated alkyl ester polyethers, poly(caprolactone), carbowax or poly(ethylene glycols). Suitable polymeric binders for the slipping layer include poly(vinyl alcohol-co-butyral), poly(vinyl alcohol-co-acetal), poly(styrene), poly(vinyl acetate), cellulose acetate butyrate, cellulose acetate, or ethyl cellulose.

The amount of the lubricating material to be used in the slipping layer depends largely on the type of lubricating material, but is generally in the range of from about 0.001 to about 2 g/m$^2$. If a polymeric binder is employed, the lubricating material is present in the range of 0.1 to 50 wt %, preferably 0.5 to 40, of the polymeric binder employed.

As noted above, the dye-donor elements and receiving elements of the invention are used to form a dye transfer image. Such a process comprises imagewise-heating a dye-donor element as described above and transferring a dye image to a dye-receiving element to form the dye transfer image.

The dye-donor element may be used in sheet form or in a continuous roll or ribbon. If a continuous roll or ribbon is employed, it may have only one dye thereon or may have alternating areas of different dyes, such as sublimable cyan, magenta, yellow, black, etc., as described in U.S. Pat. No. 4,541,830. Thus, one-, two- three- or four-color elements (or higher numbers also) are included within the scope of the invention.

In a preferred embodiment, the dye-donor element comprises a poly(ethylene terephthalate) support coated with sequential repeating areas of cyan, magenta and yellow dye, and the above process steps are sequentially performed for each color to obtain a three-color dye transfer image. Of course, when the process is only performed for a single color, then a monochrome dye transfer image is obtained.

Another aspect of the present invention relates to a method of forming an image comprising imagewise thermally transferring dyes onto a receiving element according to the present invention, such that the microbeads soften during the thermal printing process.

In a preferred embodiment of the invention, a dye-donor element may be employed which comprises a poly(ethylene terephthalate) support coated with sequential repeating areas of cyan, magenta and yellow dye, and the dye transfer steps are sequentially performed for each color to obtain a three-color dye transfer image. Of course, when the process is only performed for a single color, then a monochrome dye transfer image may be obtained. The dye-donor element may also contain a colorless area which may be transferred to the receiving element to provide a protective overcoat. This protective overcoat may be transferred to the receiving element by heating uniformly at an energy level equivalent to 85% of that used to print maximum image dye density.

Thermal printing heads which can be used to transfer dye from the dye-donor elements to the receiving elements are available commercially. There can be employed, for example, a Fujitsu Thermal Head (FTP-040MCS001), a TDK Thermal Head F415 HH7-1089 or a Rohm Thermal Head KE 2008-F3.

A thermal dye transfer assemblage of the invention comprises: a) a dye-donor element as described above, and b) a dye-receiving element as described above, the dye-receiving element being in a superposed relationship with the dye-donor element so that the dye layer of the donor element is in contact with the dye image-receiving layer of the receiving element. The above assemblage comprising these two elements may be pre-assembled as an integral unit when a monochrome image is to be obtained. This may be done by temporarily adhering the two elements together at their margins. After transfer, the dye-receiving element is then peeled apart to reveal the dye transfer image.

When a three-color image is to be obtained, the above assemblage is formed on three occasions during the time when heat is applied by the thermal printing head. After the first dye is transferred, the elements are peeled apart. A second dye-donor element (or another area of the donor element with a different dye area) is then brought in register with the dye-receiving element and the process repeated. The third color is obtained in the same manner.

In a preferred embodiment of the invention, a dye-donor element is employed which comprises a poly(ethylene terephthalate) support coated with sequential repeating areas of cyan, magenta and yellow dye, and the dye transfer steps are sequentially performed for each color to obtain a three-color dye transfer image. Of course, when the process is only performed for a single color, then a monochrome dye transfer image is obtained. The dye-donor element may also contain a colorless area which is transferred to the receiving element to provide a protective overcoat. This protective overcoat is transferred to the receiving element by heating uniformly at an energy level equivalent to about 85% of that required to print maximum image dye density.

Thermal printing heads which can be used to transfer dye from dye-donor elements to the receiving elements of the invention are available commercially. There can be employed, for example, a Fujitsu Thermal Head (FTP040 MCS001), a TDK Thermal Head F415 HH7-1089or a Rohm Thermal Head KE 2008-F3. Alternatively, other known sources of energy for thermal dye transfer may be used, such as lasers as described in, for example, GB No. 2,083,726A.

A thermal dye transfer assemblage of the invention comprises (a) a dye-donor element, and (b) a dye-receiving element as described above, the dye-receiving element being in a superposed relationship with the dye-donor element so that the dye layer of the donor element is in contact with the dye image-receiving layer of the receiving element.

When a three-color image is to be obtained, the above assemblage is formed on three occasions during the time when heat is applied by the thermal printing head. After the first dye is transferred, the elements are peeled apart. A second dye-donor element (or another area of the donor element with a different dye area) is then brought in register with the dye-receiving element and the process repeated. The third color is obtained in the same manner.

The following examples are provided to illustrate the invention. They are not intended to be exhaustive of all possible variations of the invention. Parts and percentages are by weight unless otherwise indicated.

EXAMPLES

The following is an illustrative example of a possible procedure for preparing the cross-linked organic coated with slip agent. In this example, the polymer is polymethyl (methacrylate) cross-linked with divinylbenzene. The crosslinked organic microbeads have a coating of silica. The crosslinked organic microbeads may be prepared by a procedure in which monomer droplets containing an initiator may be sized and heated to give solid polymer spheres of the same size as the monomer droplets. A water phase is prepared by combining 7 liters of distilled water, 1.5 g potassium dichromate (polymerization inhibitor for the aqueous phase), 250 g polymethylaminoethanol adipate (promoter), and 350 g LUDOX® (a colloidal suspension containing 50% silica sold by DuPont). A monomer phase is prepared by combining 3317 g methyl(methacrylate), 1421 g divinylbenzene (55% active cross-linking agent; other 45% is ethyl vinyl benzene which forms part of the methyl (methacrylate) polymer chain) and 45 g VAZO® S2 (a monomer-soluble initiator sold by DuPont). The mixture is passed through a homogenizer to obtain 1.7 μm droplets. The suspension is heated overnight at 52° C. to give 4.3 kg of generally spherical crosslinked organic microbeads having an average diameter of about 5 μm with narrow size distribution (about 1–3 μm size distribution). The mol proportion of styrene and ethyl vinyl benzene to divinylbenzene is about 6.1%. The concentration of divinylbenzene may be adjusted up or down to result in about 2.5–50% (preferably 10–40%) cross-linking by the active cross-linker.

Example 1

Preparation of Microvoided Film Support:

A 2-layer film, with designated layer 2 and layer 3, comprising a voided polyester matrix layer can be prepared in the following manner. Materials used in the preparation of layer 2 of the film were a compounded blend consisting of 35% by weight PETG 6763 resin (IV=0.73 dl/g) (an amorphous polyester resin available from Eastman Chemical Company), 35% by weight polyethylene terephthalate (PET #7352 from Eastman Chemicals), and 30% by weight cross-linked spherical poly(methyl methacrylate), (PMMA), crosslinked organic beads 1.7 μm in diameter. The crosslinked organic beads were prepared by the limited coalescence method described heretofore. The beaded poly (methyl methacrylate) was compounded with the polyester blend through mixing in a counter-rotating twin screw extruder attached to a pelletizing die forming pellets of the resin mixture. Then, polyethylene terephthalate (PET #7352 from Eastman Chemicals) was dry blended with Polypropylene ("PP", Huntsman P4G2Z-073AX) at 20% weight based on the total weight of the blend. This blend was then further blended with the aforementioned PMMA/polyester pellets at a 1:1 weight ratio. This final blend was dried in a desiccant dryer at 65° C. for 12 hours.

As the material for layer 3, PET (#7352 from Eastman Chemicals) was dry blended with polypropylene("PP", Huntsman P4G2Z-073AX) at 20% weight and dried in a desiccant dryer at 65° C. for 12 hours.

Cast sheets were co-extruded to produce a combined layer 2/layer 3 structure using a 2½" extruder to extrude the PET/PP blend, layer (3), and a 1" extruder to extrude the compounded pellets, layer (2). The 275° C. melt streams were fed into a 7 inch multi-manifold die also heated at 275° C. As the extruded sheet emerged from the die, it was cast onto a quenching roll set at 55° C. The PP in the PET matrix of layer (3) dispersed into globules between 10 and 30 μm in size during extrusion. The final dimensions of the continuous cast sheet were 18 cm wide and 480 μm thick. Layer (3) was 350 μm thick while layer (2) was 130 μm thick. The cast sheet was then stretched at 110° C. first 3.0 times in the X-direction and then 3.4 times in the Y-direction. The stretched sheet was then Heat Set at 150° C.

Preparation of Dye-Receiving Element:

A thermal dye-receiving element was prepared from the above receiver support by first laminating the above receiver to a 7 mil photographic grade paper support and then coating the following layers, in order, to the top surface (layer 2) of the microvoided film:

a) a subbing layer containing Prosil 221 (0.055 g/m$^2$) and PROSIL 2210 (0.055 g/m$^2$) (PCR Inc.) (both are organo-oxysilanes) along with LiCl (0.0033 g/m$^2$) in an ethanol-methanol-water solvent mixture. The resultant solution (0.1133 g/m$^2$) contained approximately 1% of silane component, 1% water and 98% of 3A alcohol.

b) A dye-receiving layer, layer 1 containing a random terpolymer of bisphenol A polycarbonate (50 mole %), diethylene glycol (49 mole %) and polydimethylsiloxane (1 mole %) (2500 MW) block units (0.66 g/m$^2$), a random polyester terpolymer of 1,4-cyclohexylterepbthalate, ethylene glycol, and 4,4'-bis(hydroxyethyl) bisphenol A (1.74 g/m$^2$), GE LEXAN 141–112 (a bisphenol A polycarbonate) (General Electric Co.) (1.43 g/m$^2$), Drapex 429 polyester plasticizer (Witco Corp.) (0.20 g/m$^2$), dioctyl sebacate (Aldrich Co.) (0.20 g/m$^2$), TINUVAN 123 (a hindered aminoether)(Ciba Chem. Co.) (0.40 g/m$^2$), and FLUORAD FC-431 (a perfluorinated alkylsulfonamidoalkylester surfactant)(3M Co.) (0.011 g/m$^2$), and was coated from a solvent mixture of dichloromethane and trichloroethylene.

For Examples 2 through 4 below, the dye receiving layer, layer 1, was coextruded integrally with layers 2 and 3. The resin pellets used to extrude the dye receiving layer were formulated by introducing the following components into a LEISTRITZ 27 mm Twin Screw Compounding Extruder heated to 210° C.:

1) Polyester: 157.45 kg (914.46 moles) of cis and trans isomers of cyclohexanedicarboxylic acid, 144.66 kg (457.23 moles) of bisphenol A diethanol, 2.45 kg (18.29 moles) of trimethylolpropane, 66.47 kg (460.89 moles) of cis and trans isomers of cyclohexane dimethanol and 82.51 g of butylstannoic acid catalyst were added to a 150 gallon polyester reactor equipped with a low speed helical agitator. The batch was heated to a final temperature of 275° C. The water byproduct of the esterification reaction began to distill over at 171° C. after about two hours of heat-up. Two hours later at an internal temperature of 267° C., the reactor pressure was ramped down at 10 mm Hg per minute to 3 mm Hg absolute pressure. After two hours under vacuum, the pressure was reduced to 1 mm Hg. After 3 hours and 30 minutes total under vacuum the vacuum was relieved with nitrogen and the very viscous polyester was drained from the reactor onto trays which cooled overnight. The solidified polyester was ground through a ¼" screen. The inherent viscosity in methylene chloride at 0.25% solids was 0.58, the absolute Mw was 102,000, the Mw/Mn was 6.3 and the glass transition temperature by DSC on the second heat was 55.8° C.

2) Polycarbonate (Lexan® 141 from GE Polymers) at 29.2% wt

3) Polyester elastomer with Silicone (MB50–10 from Dow Coming) at 4% wt

4) Dioctyl Sebacate(from Acros Organics) at 2.6% wt.

5) Poly(1,3-butylene glycol adipate) (Admex® 429) at 2.6% wt

6) Stabilizer(Weston® 619) at 0.2%

The melted mixture was extruded as a strand into a water bath and then pelletized.

Example 2

This example illustrates the preparation of an alternative microvoided dye-transfer dye-image receiving element of the present invention. A 3 layer film, designated layers 1,2 and 3, comprising a voided polyester matrix layer can be prepared in the following manner. Materials used in the preparation of layer 2 of the film were a compounded blend consisting of 35% by weight PETG 6763 resin (IV=0.73 dl/g) (an amorphous polyester resin available from Eastman Chemical Company), 35% by weight polyethylene terephthalate (PET #7352 from Eastman Chemicals), and 30% by weight cross-linked spherical poly(methyl methacrylate), (PMMA), crosslinked organic beads 1.7 μm in diameter. The crosslinked organic beads were prepared by the limited coalescence method described heretofore. The beaded poly (methyl methacrylate) was compounded with the polyester blend through mixing in a counter-rotating twin screw extruder attached to a pelletizing die forming pellets of the resin mixture. Then, polyethylene terephthalate (PET #7352 from Eastman Chemicals) was dry blended with Polypropylene ("PP", Huntsman P4G2Z-073AX) at 20% weight based on the total weight of the blend. This blend was then further blended with the aforementioned PMMA/polyester pellets at a 1:1 weight ratio. This final blend was dried in a desiccant dryer at 65° C. for 12 hours.

As the material for layer 3, PET (#7352 from Eastman Chemicals) was dried in a desiccant dryer at 65° C. for 12 hours.

Then the resin pellets formulated as described above for the extruded dye receiving layer, layer 1, were dried in a desiccant dryer at 50° C. for 12 hours.

Cast sheets were co-extruded to produce a three layer structure using a 2½" extruder to extrude the PET layer 3, a 1" extruder to extrude the compounded pellets of polyester, polypropylene, and microbeads, layer 2, and a ¾" extruder to extrude the compounded pellets of dye-receiving layer, layer 1. Layers 2 and 3 were extruded at 275° C. while layer 1 was extruded at 250° C. The melt streams were fed into a 7 inch multi-manifold die heated at 275° C. As the extruded sheet emerged from the die, it was cast onto a quenching roll set at 55° C. The final dimensions of the continuous cast sheet were 18 cm wide and 480 μm thick. Layer (3) was 310 μm thick while layer (2) was 130 μm thick and layer 1 was 40 μm thick. The cast sheet was then stretched at 110° C. first 3.0 times in the X-direction and then 3.4 times in the Y-direction. The stretched sheet was then Heat Set at 150° C. This composite film was then laminated to a 7 mil photographic grade paper support.

Example 3 (Comparative)

This example illustrates the preparation of microvoided dye-transfer dye-image receiving elements for comparison to the present invention, in which a comparative layer 2 comprises only crosslinked organic beads. A LEISTRITZ 27 mm Twin Screw Compounding Extruder heated to 275° C. was used to mix 1.7 μm beads made from 70 wt % methylmethacrylate crosslinked 30 wt % with divinylbenzene (Tg=160° C.) with 130 μm and a 1:1 blend of poly (ethylene terephthalate)("PET", commercially available as #7352 from Eastman Chemicals) and PETG 6763 polyester copolymer (poly(1,4-cyclohexylene dimethylene terephthalate)) from Eastman Chemicals). All components were metered into the compounder and one pass was sufficient for dispersion of the beads into the polyester matrix. The microbeads were added to attain a 30% by weight loading in the polyester. The compounded material was extruded through a strand die, cooled in a water bath, and pelletized. The pellets were then dried in a desiccant dryer at 65° C. for 12 hours. Then the resin pellets formulated as described above for the extruded dye receiving layer were dried in a desiccant dryer at 50° C. for 12 hours.

For the layer 3, PET (#7352 from Eastman Chemicals) was dried in a desiccant dryer at 150° C. for 12 hours.

Cast sheets were co-extruded to produce a three layer structure using a 2½" extruder to extrude a PET, layer 3, a 1" extruder to extrude the compounded pellets of polyester and microbeads, layer 2, and a ¾" extruder to extrude the compounded pellets of dye receiving layer, layer 1. Layers 2 and 3 were extruded at 275° C. while layer 1 was extruded at 250° C. The melt streams were fed into a 7 inch multi-manifold die heated at 275° C. As the extruded sheet emerged from the die, it was cast onto a quenching roll set at 55° C. The final dimensions of the continuous cast sheet were 18 cm wide and 480 μm thick. Layer (3) was 310 μm thick while layer (2) was 130 μm thick and layer 1 was 40 μm thick. The cast sheet was then stretched at 110° C. first 3.0 times in the X-direction and then 3.4 times in the Y-direction. The stretched sheet was then Heat Set at 150° C. This composite film was then laminated to a 7 mil photographic grade paper support.

Example 4 (Comparative)

This example illustrates the preparation of microvoided dye-transfer receiving elements for comparison to the present invention, in which a comparative layer 2 comprises only non-crosslinked polymer particles that are immiscible with the polyester matrix. Polyethylene terephthalate (PET #7352 from Eastman Chemicals) was dry blended with Polypropylene ("PP", Huntsman P4G2Z-073AX) at 20% weight based on the total weight of the blend. This blend was dried in a desiccant dryer at 65° C. for 12 hours. Then the resin pellets formulated as described above for the extruded dye receiving layer were dried in a desiccant dryer at 50° C. for 12 hours.

Then PET (#7352 from Eastman Chemicals) was dried in a desiccant dryer at 150° C. for 12 hours.

Cast sheets were co-extruded to produce a three layer structure using a 2½" extruder to extrude the PET, layer 3, a 1" extruder to extrude the blended pellets of polyester and polypropylene, layer 2, and a ¾" extruder to extrude the compounded pellets of dye receiving layer, layer 1. Layers 2 and 3 were extruded at 275° C. while layer 1 was extruded at 250° C. The melt streams were fed into a 7 inch multi-manifold die heated at 275° C. As the extruded sheet emerged from the die, it was cast onto a quenching roll set at 55° C. The final dimensions of the continuous cast sheet were 18 cm wide and 480 μm thick. Layer (3) was 310 μm thick while layer (2) was 130 μm thick and layer 1 was 40 μm thick. The cast sheet was then stretched at 110° C. first 3.0 times in the X-direction and then 3.4 times in the Y-direction. The stretched sheet was then Heat Set at 150° C. This composite film was then laminated to a 7 mil photographic grade paper support.

Preparation of Dye-Donor Elements

The dye-donor used in the example is Kodak Ektatherm ExtraLife® donor ribbon.

Dye-Donor Element

A 4-patch protective layer dye-donor element was prepared by coating on a 6 μm poly(ethylene terephthalate) support:

1) a subbing layer of titanium alkoxide (DuPont TYZOR TBT® (0.12 g/m2) from a n-propyl acetate and n-butyl alcohol solvent mixture, and 2) a slipping layer containing an aminopropyidimethyl-terminated polydimethylsiloxane, PS513® (United Chemical Technologies, Inc.)(0.01 g/m2), a poly(vinyl acetal) binder, KS-1 (Sekisui Co.) (0.38 g/m2), p-toluenesulfonic acid (0.0003 g/m$^2$), polymethylsilsesquioxane beads 0.5 μm (0.06 g/m$^2$ ) and candellila wax (0.02 g/m$^2$) coated from a solvent mixture of diethyl ketone and methanol.

On the opposite side of the support was coated:

1) a patch-coated subbing layer of titanium alkoxide (TYZOR TBT)® (0.13 g/m$^2$) from a n-propyl acetate and n-butyl alcohol solvent mixture, and 2) repeating yellow, magenta and cyan dye patches containing the compositions as noted below over the subbing layer and a protective patch on the unsubbed portion as identified below.

The yellow composition contained 0.07 g/m$^2$ of the first yellow dye illustrated above, 0.09 g/m$^2$ of the second yellow dye illustrated above, 0.25 g/m$^2$ of CAP48220 (20 s viscosity) cellulose acetate propionate, 0.05 g/m$^2$ of Paraplex G-25® plasticizer and 0.004 g/m$^2$ divinylbenzene beads (2 μm beads) in a solvent mixture of toluene, methanol and cyclopentanone (66.5/28.5/5).

The magenta composition contained 0.07 g/m$^2$ of the first magenta dye illustrated above, 0.14 g/m$^2$ of the second magenta dye illustrated above, 0.06 g/m$^2$ of the third magenta dye illustrated above, 0.28 g/m$^2$ of CAP482-20 (20 s viscosity) cellulose acetate propionate, 0.06 g/m$^2$ of Paraplex G-25® plasticizer, 0.05 g/m$^2$ of monomeric glass illustrated below, and 0.005 g/m$^2$ divinylbenzene beads (2 μm beads) in a solvent mixture of toluene, methanol and cyclopentanone (66.5/28.5/5).

The cyan composition contained 0.10 g/m$^2$ of the first cyan dye illustrated above, 0.09 g/m2 of the second cyan dye illustrated above, 0.22 g/m$^2$ of the third cyan dye illustrated above, 0.23 g/m$^2$ of CAP482-20 (20 s viscosity) cellulose acetate propionate, 0.02 g/m$^2$ of Paraplex G-25® plasticizer, 0.04 g/m$^2$ of monomeric glass illustrated below, and 0.009 g/m$^2$ divinylbenzene beads (2 μm beads) in a solvent mixture of toluene, methanol and cyclopentanone (66.5/28.5/5).

The protective patch contained a mixture of poly(vinyl acetal) (0.53 g/m$^2$) (Sekisui KS-10), colloidal silica IPA-ST (Nissan Chemical Co.) (0.39 g/m$^2$) and 0.09 g/m$^2$ of divinylbenzene beads (4 μm beads) which was coated from a solvent mixture of diethylketone and isopropyl alcohol (80:20).

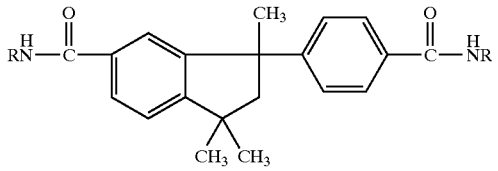

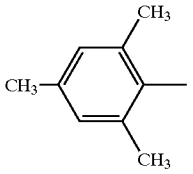

Evaluation of Dye-Transfer Printing Quality

An eleven-step sensitometric full color image was prepared from the above dye-donor and dye-receiver elements by printing the donor-receiver assemblage in a KODAK 8650 Thermal Printer. The dye-donor element was placed in contact with the polymeric receiving layer side of the receiver element. The assemblage was positioned on an 18 mm platen roller and a TDK LV5406A thermal head with a head load of 6.35 Kg was pressed against the platen roller. The TDK LV5406A thermal print head has 2560 independently addressable heaters with a resolution of 300 dots/inch and an average resistance of 3314Ω. The imaging electronics were activated when an initial print head temperature of 36.4° C. had been reached. The assemblage was drawn between the printing head and platen roller at 16.9 mm/sec. Coincidentally, the resistive elements in the thermal print head were pulsed on for 58 μsec every 76 μsec. Printing maximum density utilized 64 pulses "on" time per printed line of 5.0 msec. The voltage supplied at 13.6 volts resulted in an instantaneous peak power of approximately 58.18× 10-3 Watt/dot and the maximum total energy used to print Dmax was 0.216 mJoules/dot. This printing process heated the laminate uniformly with the thermal head to permanently adhere the laminate to the print. The donor support was peeled away as the printer advanced through its heating cycle, leaving the laminate adhered to the imaged receiver.

Visual evaluation of the images on the receivers after printing was done. The color density of examples 1 thru 3 was good while that of example 4 was only fair. Grainy appearance is a very displeasing feature in images significantly reducing their commercial value. Ratings of the degree of grainy appearance in the low density printed areas of examples 1 thru 3 was good while that of example 4 was poor.

Table 1 below summarizes the image quality of Examples 1 through 4 and includes a description of the materials used in layers 2 and 3 as well as the method by which layer 1 was produced. It also summarizes the tearability of the media during processing as well as gives a relative cost of the media based on materials used.

TABLE 1

| Sample | Layer 3 Material | Layer 2 Voiding Agent | Layer 2 Matrix Polymer(s) | Layer 1 Coated or Coex'd | Tearability | Image Density | Grain | Relative Cost |
|---|---|---|---|---|---|---|---|---|
| Example 1 | PET/PP | PP & PMMA Microbeads | PET/PETG | Coated | Good | Good | Good | Medium |
| Example 2 | PET | PP & PMMA Microbeads | PET/PETG | Coex'd | Good | Good | Good | Medium |
| Example 3 (Comp.) | PET | PMMA Microbeads | PET/PETG | Coex'd | Fair | Good | Good | High |
| Example 4 (Comp.) | PET | PP | PET | Coex'd | Good | Fair | Poor | Low |

It is evident from Table 1 that the blend of microbeads and miscible polymer, in this case polypropylene, offers a processable moderate cost thermal dye-transfer receiver with both good image density and good (low) grainy appearance while exhibiting good tearability.

The invention has been described in detail with particular reference to preferred embodiments thereof, but it will be understood that variations and modifications can be effected within the spirit and scope of the invention. The entire contents of the patents and other publications referred to in this specification are incorporated herein by reference.

What is claimed is:

1. A thermal dye-transfer receiver element comprising:

(a) a dye-receiving layer 1;

(b) beneath layer 1, a microvoided layer 2 containing a continuous phase polyester matrix having dispersed therein a mixture of crosslinked organic microbeads and non-crosslinked polymer particles that are immiscible with the polyester matrix, said layer 2 having a void volume of at least 25% by volume;

(c) beneath layer 2, a substrate layer 3 comprised of a voided or non-voided polyester material; and (d) beneath layer 3, a support 4.

2. The thermal dye-transfer receiver element of claim 1 in which substrate layer 3 comprises a continuous phase polyester matrix having dispersed therein substantially only non-crosslinked polymer particles that are immiscible with the polyester matrix having a void volume between 5 and 25%.

3. The element of claim 1 wherein the substrate layer 3 comprises non-voided polyester.

4. The element of claim 1 wherein the microvoided layer 2 has a void volume of from 25 to 65 volume %.

5. The element of claim 1 wherein said continuous phase polyester matrix of said microvoided layer 2 comprises polyethylene(terephthalate) or a copolymer thereof.

6. The element of claim 1 wherein said continuous phase polyester matrix of said microvoided layer 2 comprises a blend comprising polyethylene(terephthalate) and poly(1,4-cyclohexylene dimethylene terephthalate).

7. The element of claim 1 wherein said crosslinked organic microbeads comprise at least one of styrene, butyl acrylate, acrylamide, acrylonitrile, methyl methacrylate, ethylene glycol dimethacrylate, vinyl pyridine, vinyl acetate, methyl acrylate, vinylbenzyl chloride, vinylidene chloride, acrylic acid, divinylbenzene, arylamidomethyl-propane sulfonic acid, vinyl toluene, and trimethylol propane triacrylate.

8. The element of claim 1 wherein said crosslinked organic microbeads comprise a poly(methyl methacrylate) or poly(butyl acrylate) polymer.

9. The element of claim 1 wherein said non-crosslinked polymer particles that are immiscible with said polyester matrix have an olefinic backbone.

10. The element of claim 9 wherein said non-crosslinked polymer particles that are immiscible with said polyester matrix comprise polymers derived from a monomer selected from propylene or ethylene.

11. The element of claim 10 wherein said non-crosslinked polymer particles comprise polypropylene.

12. The element of claim 1 wherein said microvoided layer 2 has a density of less than 0.95 grams/cc.

13. The element of claim 1 wherein said microvoided layer 2 has a density of from 0.4 to 0.90 grams/cc.

14. The element of claim 1 wherein the total thickness of said microvoided layer 2 is from 20 to 400 micrometers.

15. The element of claim 1 wherein said dye-receiving layer 1 comprises a polymeric binder containing a polyester and/or polycarbonate.

16. The element of claim 15 wherein the polymeric binder is a blend of the polyester and the polycarbonate and the blend is present in the dye-receiving layer 1 in a weight ratio of 90:10 to 10:90.

17. The element of claim 15 wherein said dye-receiving layer further comprises a polydimethylsiloxane-containing copolymer.

18. The element of claim 15 wherein said dye-receiving layer further comprises a plasticizer that is an ester compound or a polyester.

19. The element of claim 18 wherein said plasticizer comprises poly(butylene glycol adipate).

20. The element of claim 1 wherein a subbing layer is present between said substrate layer 3 and said support 4.

21. The element of claim 1 wherein said support comprises paper.

22. The element of claim 1 wherein said support comprises a polymer sheet.

23. The element of claim 22 wherein said polymer sheet is voided or non-voided.

24. The element of claim 23 wherein said polymer sheet is oriented.

25. The element of claim 1 wherein the ratio of the volume of crosslinked organic microbeads to the volume of said non-crosslinked polymer particles that are immiscible with said polyester matrix is from 4:1 to 1:4.

26. The element of claim 1 wherein the ratio of the volume of crosslinked organic microbeads to the volume of said non-crosslinked polymer articles that are immiscible with said polyester matrix is (3:2 to 2:3).

27. The element of claim 1 wherein one or more subbing layers are present between layers in the element.

28. A thermal dye transfer assemblage comprising a dye-donor element, and the dye-transfer receiver element of claim 1.

29. A method of forming an image comprising imagewise thermally transferring dyes onto the element of claim 1.

30. A process for making a thermal dye-transfer receiving element comprising the following steps:

a) coextruding to form a cast composite film comprising at least two layers, a first layer comprising a non-voided thermoplastic polymeric material and a second layer comprising a continuous phase polymer matrix having dispersed therein crosslinked organic microbeads and non-crosslinked particles that are immiscible with the polyester matrix; and b) stretching said cast composite film biaxially to reduce its thickness, thereby obtaining an oriented composite film comprising, as the first layer, a dye-receiving layer and, as the second layer, a microvoided compliant layer.

31. The process of claim 30 wherein, after step (b), the oriented composite film is laminated to a multilayer support, such that the microvoided compliant layer is between the dye-receiving layer and the support to produce the thermal dye-transfer receiving element.

32. The process of claim 31 wherein said support comprises cellulose fiber paper.

33. The process of claim 31 wherein said support is from 120 to 250 $\mu$m thick and said composite film is from 30 to 50 $\mu$m thick.

34. The process of claim 31 wherein a polyolefin backing layer is located on a side of the support opposite to said composite film, and during lamination, a tie layer is placed between the support and the oriented composite film.

35. The process of claim 30 wherein the continuous phase polymer matrix comprises a polyester polymer.

36. The process of claim 30 wherein a third layer comprising a continuous phase polymer matrix having dispersed therein non-crosslinked polymer particles that are immiscible with the polyester matrix is coextruded in step (a) to form the composite film, wherein the third layer is located on the side of the second layer opposite the first layer and is closest to the support when the composite film is laminated to a support.

37. A process for making a thermal dye-transfer receiver element comprising the following steps:

a) coextruding to form a cast composite film comprising at least three layers, a first layer comprising a non-voided thermoplastic polymeric material, a second layer comprising a continuous phase polymer matrix having dispersed therein crosslinked organic microbeads and non-crosslinked particles that are immiscible with the polyester matrix, and a third layer comprising a voided or non-voided thermoplastic material; and b) stretching said cast composite film to reduce its thickness, thereby obtaining an oriented composite film comprising, as the first layer, a dye-image receiving layer, as the second layer a microvoided compliant layer, and as a third layer, a microvoided or non-voided underlayer.

38. The process of claim 37 wherein said oriented composite film is laminated to a support, such that the microvoided compliant layer is between the dye-image receiving layer and the third layer, and the third layer is located on the side of the second layer opposite the first layer and closest to the support, thereby producing said thermal dye-transfer receiver element.

* * * * *